US012259127B2

(12) United States Patent
Lang et al.

(10) Patent No.: US 12,259,127 B2
(45) Date of Patent: Mar. 25, 2025

(54) FIRENADO INSERT, PIT AND METHOD

(71) Applicants: Patrick Lang, Watkinsville, GA (US); Jett J. Lang, Watkinsville, GA (US)

(72) Inventors: Patrick Lang, Watkinsville, GA (US); Jett J. Lang, Watkinsville, GA (US)

( * ) Notice: Subject to any disclaimer, the term of this patent is extended or adjusted under 35 U.S.C. 154(b) by 0 days.

(21) Appl. No.: 17/719,331

(22) Filed: Apr. 12, 2022

(65) Prior Publication Data

US 2023/0324041 A1 Oct. 12, 2023

(51) Int. Cl.
*F23C 7/00* (2006.01)

(52) U.S. Cl.
CPC ..... *F23C 7/002* (2013.01)

(58) Field of Classification Search
CPC ..... F23C 7/002
USPC ..... 126/500–555; 431/331–342, 353
See application file for complete search history.

(56) References Cited

U.S. PATENT DOCUMENTS 8,920,161 B2 * 12/2014 Moetteli ..... F23D 3/16 431/291
2012/0006316 A1 * 1/2012 Shimek ..... F23L 1/02 126/518
2014/0290643 A1 * 10/2014 Potter ..... F23C 7/004 431/126

* cited by examiner

*Primary Examiner* — Vivek K Shirsat
(74) *Attorney, Agent, or Firm* — Smith Tempel Blaha LLC; Gregory Scott Smith

(57) ABSTRACT

A device to induce a fire tornado with a swirling vortex of flames rising into the air. The device includes a flame element and a series of nozzles that deliver the flow of air into the area of the flame element. The air flow is such that eddy currents are created, which along with the heat of the flames, results in inducing the fire tornado.

5 Claims, 13 Drawing Sheets

FIRENADO INSERT, PIT AND METHOD

BACKGROUND

Fire. It is almost as if it is alive. Like any form of life, it needs fuel for sustenance. And once it is birthed, it takes on a life of its own, seeking sources of fuel, feasting upon whatever it can find, plowing forward along its own path. It is a force that is feared by most life forms. It is only mankind that has learned to capture and bridle this force of nature we call fire. Like the power of the ocean, one can easily get caught up in the beauty and the majestic allure of fire. Hours are spent in homes just daydreaming in front of the fireplace, or around fire pits or bon fires. Fire is the center of every campsite.

It has probably been ever since the discovery and bridling of fire that mankind's fascination of what can be done with fire was birthed and has continuously grown. Just look at the creations and inventions that mankind has produced all centered around the theme of fire. Torches, heaters, ovens, grills, flame throwers, fire trucks, lighters, matches, flint, fire pits, combustion engines, steam engines, locomotives, refinement of metals. The list could continue for pages and pages.

And so, this force called fire is the source of many things. Fear in animals, awe in mankind, entertainment, utility, manufacturing, transportation, comfort, as wall as a metaphor in poetry, life and music. And fire has been the motivation of many inventions, developments, and industries. But mankind is not done. The quest for new ways to use, bridle and control and simply to enjoy fire always loom ahead. Such is the motivation driving the invention presented herein.

There is a majestic phenomenon that occurs from time to time referred to as a fire whirl, or fire devil or also a fire tornado. A fire tornado is an intense rotating column of fire shooting up towards the sky that can be created as the result of fire creating an intense rising heat that is combined with a turbulent wind condition to create eddies. These eddies can contract a tornado-like vortex that sucks in debris and combustible gases.

A fire tornado, or "firenado," is thus a tornado made out of fire. The most famous example occurred when the 2018 Carr Fire spawned an EF3 fire tornado with estimated wind speeds of 143 miles per hour. It is obvious that you would never want one of these beasts sweeping through your neighborhood, but the concept of experiencing one (hopefully from a distance) is quite intriguing, yeah? Well suppose if you could actually create your own firenado in a controlled manner so that you can witness and experience of gloriousness of such a majestic phenomenon without the risk of having your belongings and loved ones swept away in a swirling vortex of fire.

As the legend Johnny Cash sang "I fell in to a burning ring of fire, I went down down down, and the flames went higher, and it burns burns burns, this ring of fire, this ring of fire." Although Johnny was singing about love, the concept of a ring of fire with flames reaching into the air, a a firenado, would fascinate even the least of the fire enthusiast and maybe even capture the attention of those that would normally be nonchalant. As such, there is a need in the art for an apparatus and a method to control the presentment of fire.

BRIEF SUMMARY

Embodiments of the present invention operate to induce or create a fire tornado with a swirling vortex of flames rising into the air. In general, the various embodiments include a flame element and a series of nozzles that deliver the flow of air into the area of the flame element. The air flow is such that eddy currents are created, which along with the heat of the flames, results in inducing the fire tornado.

One specific embodiment includes a method for inducing a flame into a fire tornado. The method includes setting a flame element within a recessed void of a shell or insert. The claim element is coupled to a fuel source and thus receives a fuel, such as propane, natural gas, etc., to be burned. The flame element is then ignited. The embodiment also includes setting a plurality of air nozzles around the periphery of the flame element and insuring that each of the plurality of air nozzles is pointing towards an edge of the flame element at an angle that is not 0 degrees, or that is greater than 0 degrees relative to a line running from the nozzle to the center of the flame element. Thus, the nozzle is not pointing directly at the edge of the flame element, but rather is at an angle that is directed towards the edge, so that the air flow is pushed around the flame element. For instance, in some embodiments the angle can range from greater than 0 to 90 degrees relative to a line passing through the nozzle to the center of the flame element. At the particular angle, the method comprises delivering air to each of the plurality of air nozzles from an air source. As a result, the air flow of air from each of the plurality of air nozzles creates eddy currents within the recessed void to induce the fire tornado.

In some embodiments, the flame element is circular, and the angle of the air flow from a particular nozzle towards the flame element is along or proximate to a tangential line. For instance, the air flow may be tangential to the edge of the flame element, plus or minus 5 degrees, or in some embodiments plus or minus 10 degrees, or in other embodiments, plus or minus 20 degrees or more.

In some embodiments, the plurality of air nozzles around the periphery of the flame element includes 2 or more nozzles, or in some embodiments 4-8 nozzles, or in some embodiments 6 nozzles.

In some embodiments, each of the plurality of air nozzles can be individually adjusted to change the particular angle of that particular nozzle. However, in some embodiments, the plurality of air nozzles are interconnected such that adjusting the angle of one of the air nozzles results in adjusting each of the remaining air nozzles.

Another embodiment includes an apparatus for inducing a flame into a fire tornado. The apparatus may be an insert that can be placed into a frame, stand, table, pit, etc. while other embodiments include a stand-alone fire pit or firenado pit. The various embodiments of the apparatus include a shell that defines a recessed void. A flame element is placed within the recessed void of the shell and is configured to receive fuel from a fuel source, such as propane, natural gas, etc. Further, the apparatus embodiments include an air source, such as a blower, a fan, a compressor, etc. A plurality of air nozzles are positioned within the recessed void around the periphery of the flame element, with each air nozzle pointing towards an edge of the flame element at an angle that is greater than 0 degrees relative to a line running from the nozzle to the center of the flame element.

These and other embodiments will be described herein below in greater detail in conjunction with the drawings.

DETAILED DESCRIPTION OF VARIOUS EMBODIMENTS ON

The present invention, as well as features and aspects thereof, is directed towards providing a fire chamber that can be inserted into a fire pit or other enclosure, and/or a fire pit that creates a controlled tornadic column of fire (aka firenado).

In general, the various embodiments create a firenado by providing a fire or flame source, along with the provision of air moving in eddy currents or turbulent wind. Combined, the two elements artificially create or form a firenado. Thus, the various embodiments include a flame source and an air-flow controlling element. The flame source is used to provide a typical, gas fed (such as propane or natural gas) flame within the confines of a fire chamber, such as a fire pit. The air-flow controlling element consists of a structure to force air at a sufficient velocity to create wind turbulence, such as a rotating air-flow or eddy current. The various embodiments, along with specific features, elements, aspects and components are presented in more detail with reference to the various drawings in which like labels represent like elements throughout the various views. The various embodiments are referred to as a firenado pit or a firenado insert that can be installed in a pit or other receptor.

Figure 1:
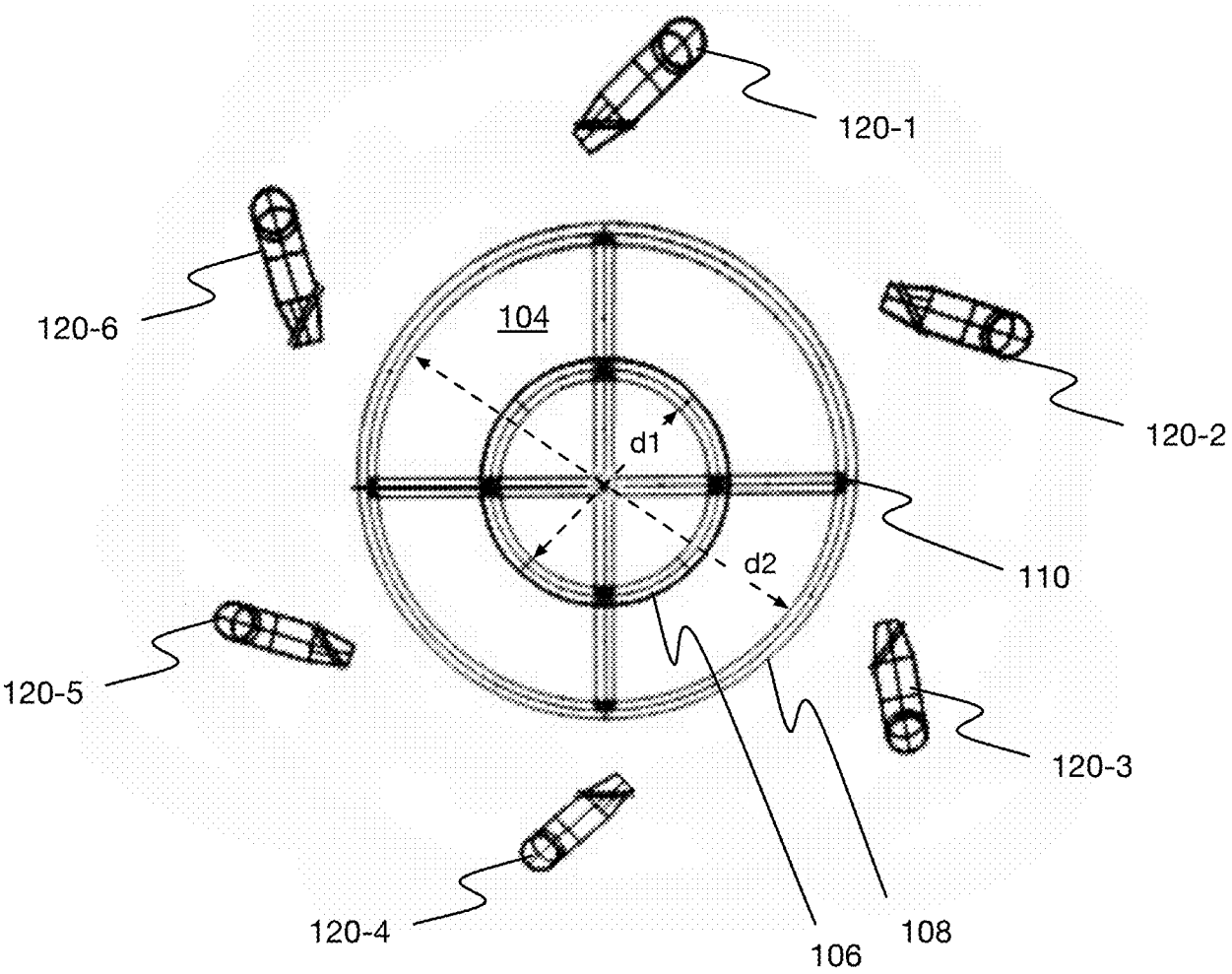
FIG. 1 is a top plan view of an exemplary arrangement of a fire source and blowers suitable for embodiments of the firenado.

FIG. 1 is a top plan view of an exemplary arrangement of a fire source and blowers suitable for embodiments of the firenado. In the illustrated embodiment, the fire source comprises a two-ring flame element 104, which includes a first ring 106 of a first diameter d1. The first ring 106 is concentric with a second ring 108 with a second and larger diameter d2. The first ring and second ring may be secured into position relative to each other with one or more cross-members 110.

Around the periphery of the fire source 104, the illustrated arrangement includes a plurality of blowers 120-1, 120-2, 120-3, 120-4, 120-5, and 120-6 (collectively referred to as 120). Each of the blowers 120 include nozzle 122 that is fed from one or more air sources (not illustrated in FIG. 1). Once fluidity is established between the air sources and nozzles 122, air is forced out of a directed opening 124 (best seen in FIG. 2) in a direction that the nozzle 120 is aiming.

Figure 2:
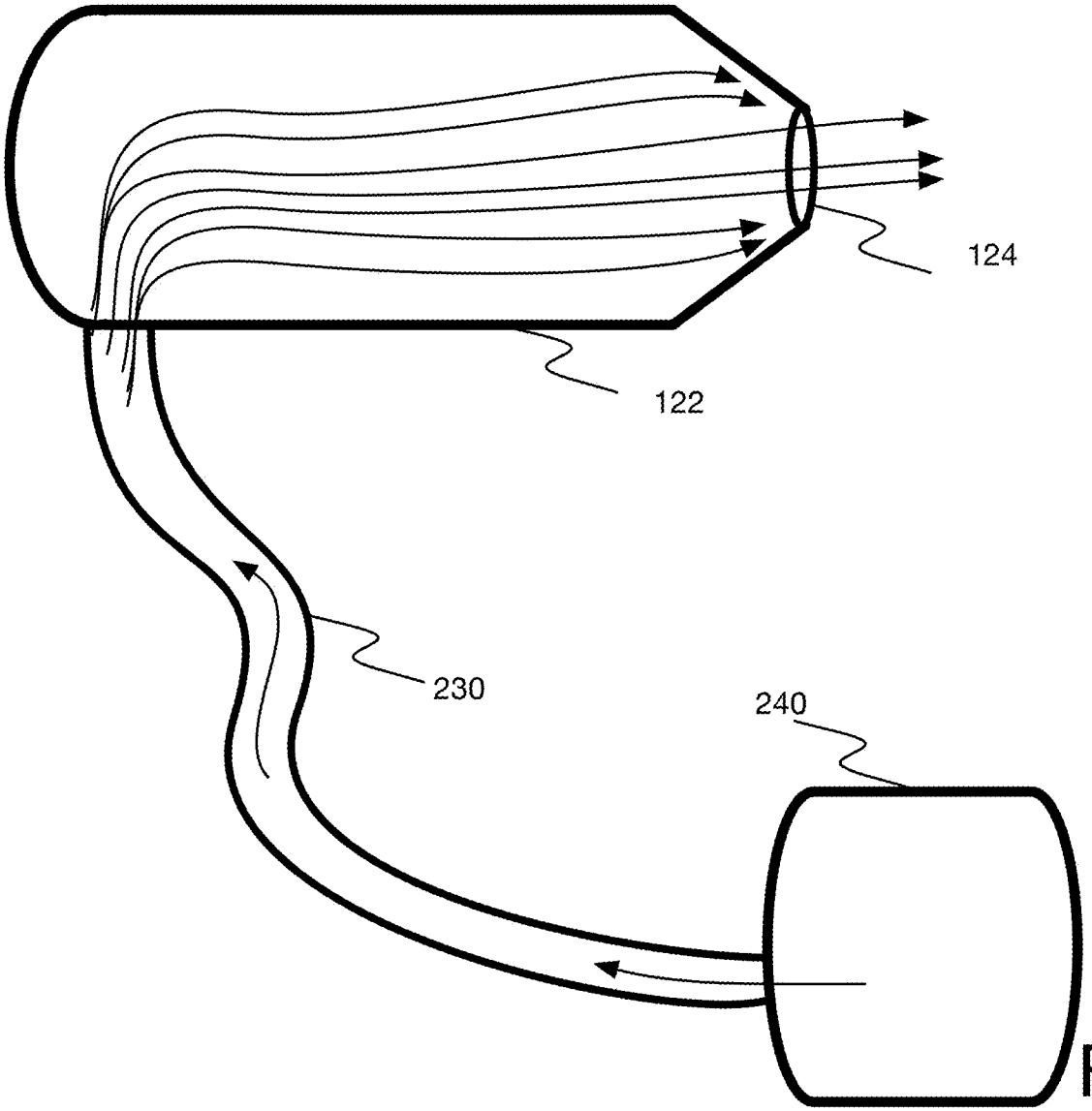
FIG. 2 is a functional diagram of a single nozzle and an air source suitable for various embodiments of the firenado.

FIG. 2 is a functional diagram of a single nozzle and an air source suitable for various embodiments of the firenado. In the illustrated embodiment, a nozzle 122 with a directed output 124 is connected to an air source 240 through a conduit 230, such as a pipe, hose, tube, etc. Once the air source 240 is enabled or turned on, air begins to flow through the conduit 230 and into the interior of the nozzle 122. The air is then forced out of the narrow opening 124 into the firenado flame area.

Figure 3:
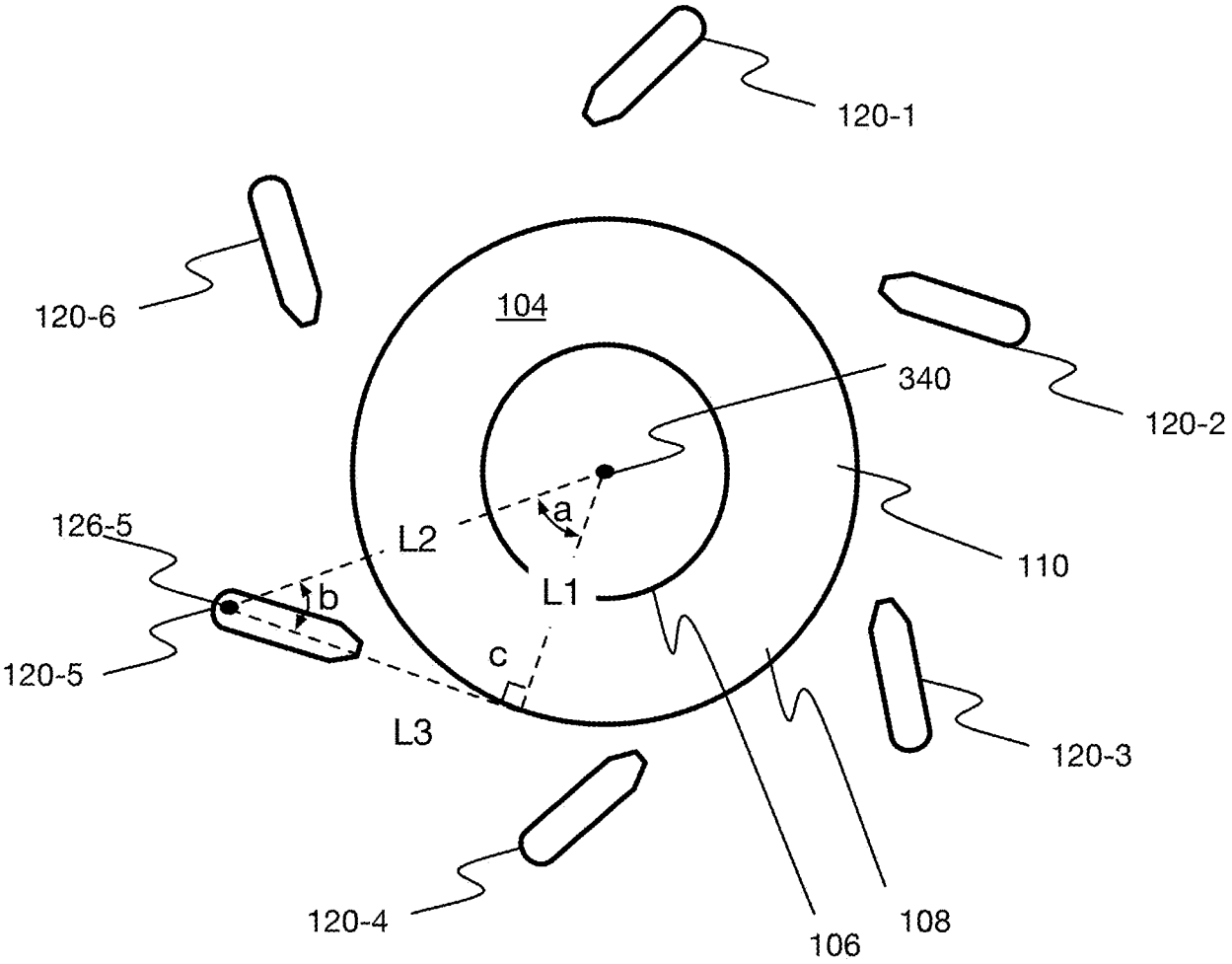
FIG. 3 is a top plan view of an exemplary arrangement of a fire source and blowers suitable for embodiments of the firenado showing the positioning of the nozzles.

FIG. 3 is a top plan view of an exemplary arrangement of a fire source and blowers suitable for embodiments of the firenado showing the positioning of the nozzles. The nozzles 120-1 through 120-6 are set direct the air-flow around the fire source 104 in such a manner to induce the fire tornado. Focusing on nozzle 120-5, a pivot point 126-5 is positioned at some point along the lateral length of the nozzle 120-5. This point may coincide with the connect of the conduit 230 interfacing the nozzle 120-5 to the air source 240 or, the point may be in addition to the conduit 230 connection. In either case, the pivot point 126-5 defines a point that the nozzle 120-5 can be pivoted around in direction the air-flow out of the nozzle 120-5 towards the fire source 104.

The pivot point 126-5 is positioned a distance L2 from a central point 340 of the fire source 104. The nozzle 120-5 is then pivoted about the pivot point 126-5 such that the air flow out of the nozzle 120-5 is directed tangentially towards the fire source 104. Once positioned the line from the central point 340 to the pivot point 126-5 of nozzle 120-5 and the line of distance L1 from the central point 126-5 to the tangential point of the air flow from the nozzle 120-5 for an angle a relative to each other. The angle of the air flow from nozzle 120-5 and the line from the central point 340 to the pivot point 126-5 of nozzle 120-5 form an angle b.

In an exemplary embodiment, L2 equals approximately 4/3*L1. As the line L3 and L1 form a right angle c, the angles a and b can be calculated using simple geometry for a right triangle. For instance, the angle b can be calculated as:

$$b=\sin^{-1}(L1/L2)=\sin^{-1}(L1/(4/3*L1)=\sin^{-1}10.75=48.5 \text{ degrees}$$

Similarly, the angle a can be calculated as follows:

$$a=\sin^{-1}(L3/L2)=\sin^{-1}(L3/(4/3*L1)=\sin^{-1}(0.75*L3/L1)$$

We also know that if b=48.5 degrees for a right triangle, then a=90−48.5 degrees or 41.5 degrees.

In the non-limiting example presented in the illustration, using the above solution for the angle b=48.5 degrees and a=41.5 degrees, the value of L1, L2 and L3 can be determined as follows:

$$L2=\sin(b)/L1=\sin(48.5 \text{ degrees})*L1=0.75/L1$$

$$L3=L1/\tan(b)=L1/\tan(48.5)=L1/0.885$$

Thus, for one non-limiting example, if the fire element 104 has a diameter of 10 inches, the L1 will be 5 inches and the configuration of the nozzles 120 will be as follows:

L2=6.667 inches

L3=5.65 inches

It should be appreciated that other configurations may also be useful and operative to create a firenado and the provided measurements are just one non-limiting example. Comparing the configuration in FIG. 3 to the configuration in FIG. 4, it is evident that if the PSI is increased for the system, the nozzles 120 can be moved such that b'<b, a'<a and L3'>L3 and L2'>L2.

If the angle b was zero, the nozzle would be pointing directly at the flame element 104. This would not result in creating the eddy currents that are desired to induce the fire tornado. As such, the nozzle is angled outward from directly pointing at the flame element 104, such that the air flow is directed more parallel to the flame element, or pushed around the edge of the flame element, thus creating a circular air flow or eddy currents. If the nozzle is turned to 90 degrees relative to the line L2, and with L2 being greater than L1, the air flow would be directed to the side of the flame element 104 and as such, to be effective at generating the eddy currents around the flame element 104, more air pressure would be required. In addition, the large the value of L2, the more air pressure will be required to generate the eddy currents necessary to induce the fire tornado. If b is greater than 90 degrees, the ability to generate the eddy currents would be greatly reduced. Thus, optimally, the angle of b will be greater than 0 degrees but less than 90 degrees.

It should be appreciated that rather than the nozzles 120 being able to swivel or rotate about the pivot point 126, the nozzles 120 may be fixed in an optimal position. It should also be appreciated that in some embodiments, the length L1 is typically fixed based on the fire source 104. As such, the position of the nozzles 120 can be adjusted based on the size of the fire source 104, the PSI of air pressure provided by the air source, the compression or air flow direction of the nozzles 120 and other environmental attributes. Ideally, from a manufacturing perspective, a value of L1, L2 and L3 and the angles a and b can be selected to induce the fire tornado most reliable, even though a range of each of these lengths and angles may result in a functional firenado. For instance, if the PSI of the air-flow delivered by the air source 240 (FIG. 2) then the lengths L2 and L3 can be lengthened as illustrated in FIG. 4.

Figure 4:
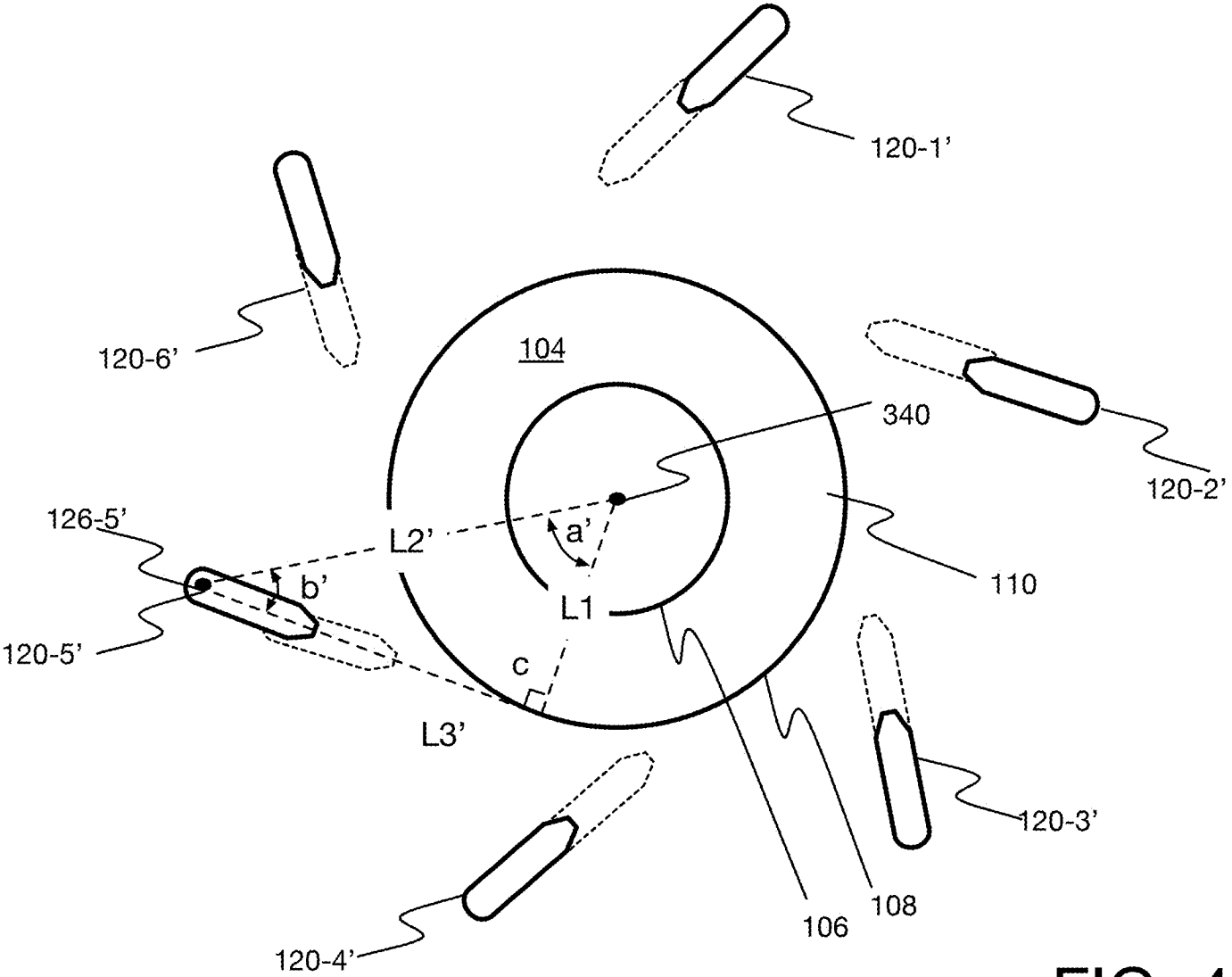
FIG. 4 is a top plan view of an exemplary arrangement of a fire source and blowers suitable for embodiments of the firenado showing the positioning of the nozzles for a higher PSI air source.

FIG. 4 is a top plan view of an exemplary arrangement of a fire source and blowers suitable for embodiments of the firenado showing the positioning of the nozzles for a higher PSI air source. With the increased PSI, each of the nozzles 120-1' to 120-6' are shown as being moved back from the fire source 104 such that the pivot point 126-5' (as an example) is further away from the central point 340 so that it is a distance L2'. Similarly, the distance from the pivot point 126-5' to the tangential touching point of the fire source 104 is increased to L3'. With the new values of L2' and L3', the angles a' and b' can be calculated.

Figure 5:
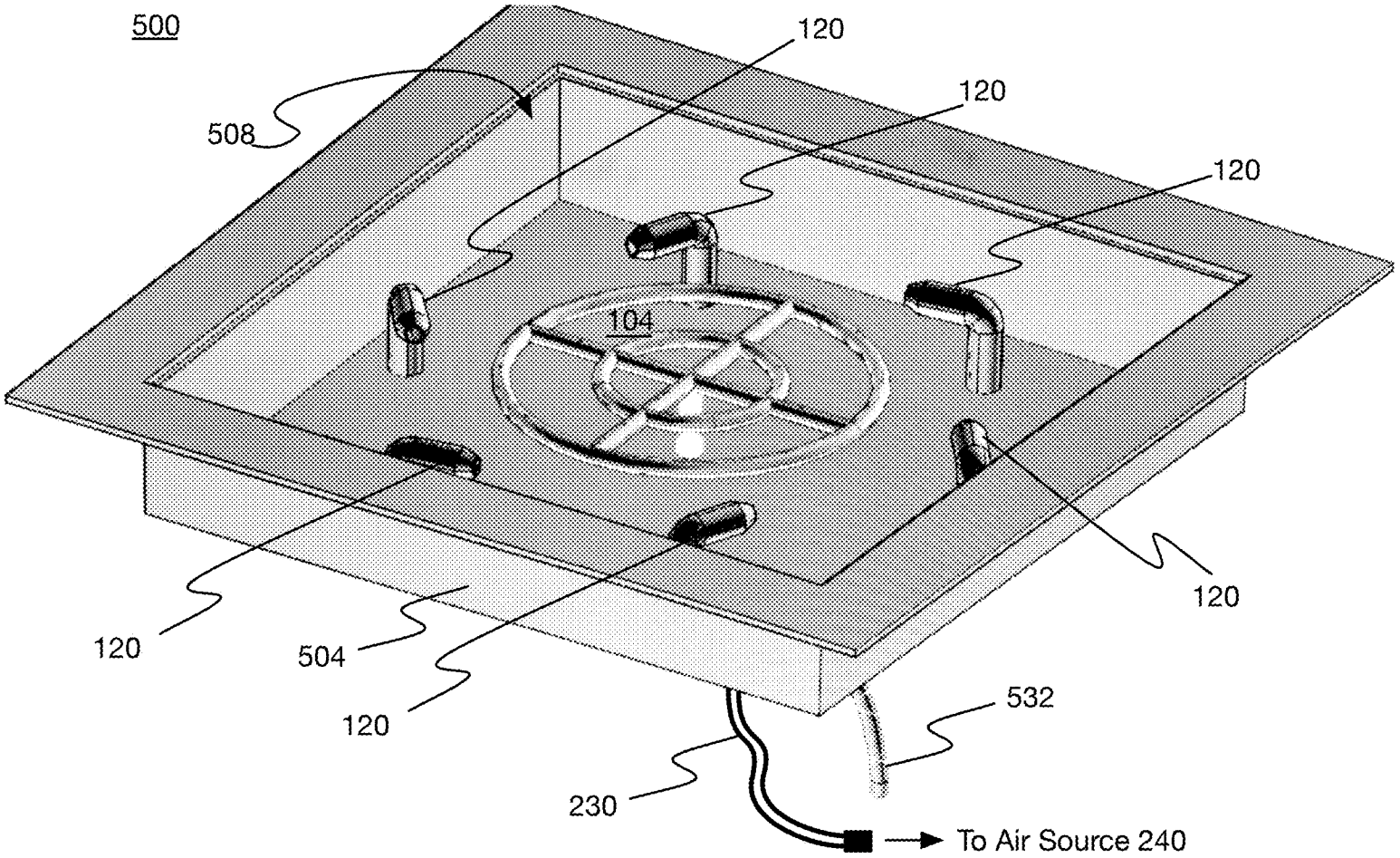
FIG. 5 is a perspective view of an exemplary embodiment of a firenado insert.

FIG. 5 is a perspective view of an exemplary embodiment of a firenado insert. The insert is designed to be slid into an existing fire pit to convert the fire pit into a firenado fire pit. The insert 500 includes a shell 504. In the illustrated embodiment, the shell 504 defines a recessed area 508 for housing the nozzles 120, flame element 104 and a walled-in area in which the air-flow can create eddy currents.

A conduit 532 is shown as feeding the flame element 104 on one end, while the other end can be connected to a gas source (not illustrated) such as a propane tank or a natural gas line, etc. Another conduit 230 is connected to the nozzles 120 on one end and to the air source (such as air source 240 in FIG. 2).

The shell 504 also defines a lip 510 around the perimeter of the recessed area 508. In the illustrated embodiment, the lip 510 can be used so set the insert on the surface of a fire pit or a void in a receptor (such as a cabinet with countertop, a void defined in a deck or patio, etc.). It should be appreciated that the insert 500 may take on a variety of forms such as the illustrated square, or a rectangular shape, triangular shape, round shape, oval shape, etc. Further, the insert may include a lip 510 as illustrated, or may also be mounted without requiring a lip. The depth of the recessed area 508 may vary between embodiments but generally, should be deep enough to ensure that the nozzles 120 are below the top edge of the recessed area 508, although it is anticipated that in some embodiments the nozzles 120 may extend above the top edge of the recessed area 508. Even in further embodiments, the insert 500 may not include a recessed area but rather, simply be a flat surface. In other embodiments, the recessed area may be bowl-shaped.

Figure 6:
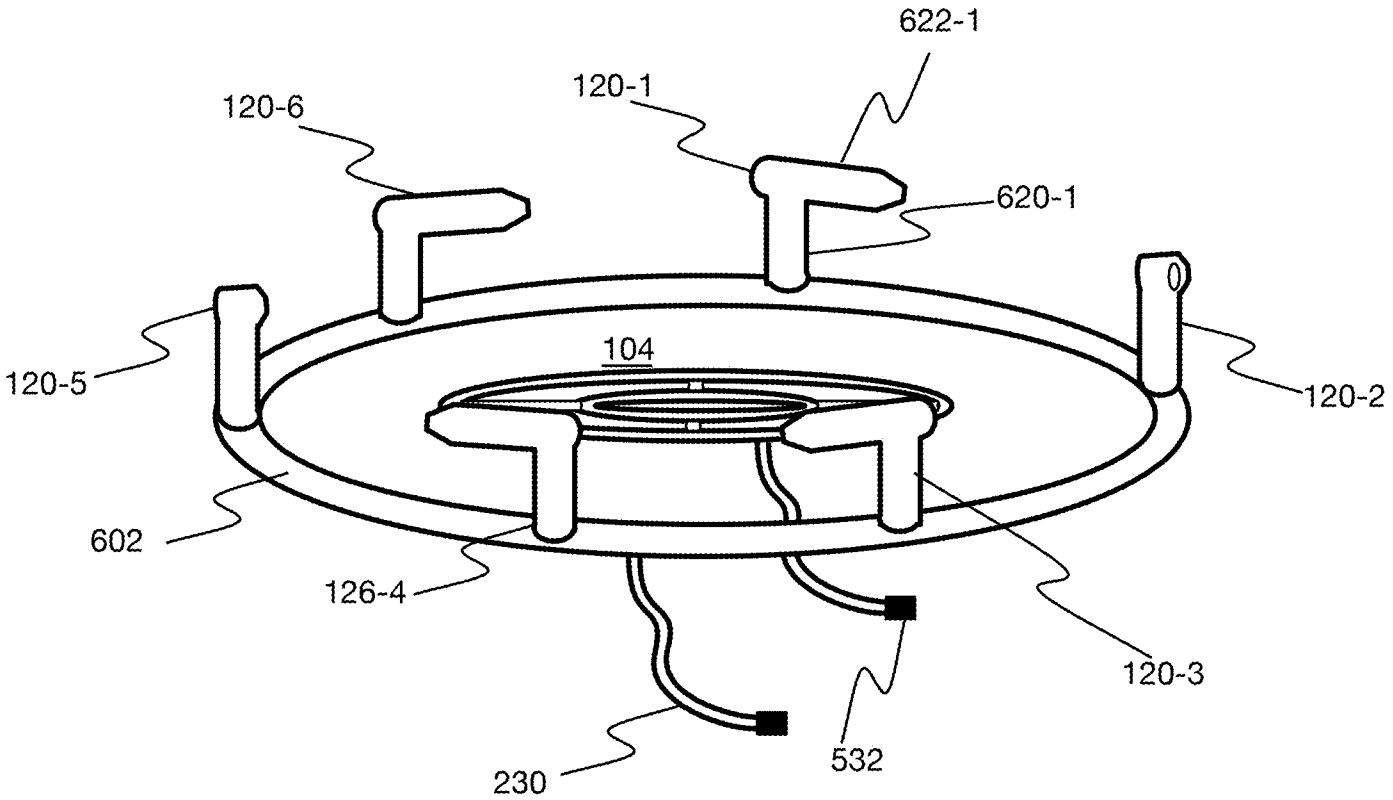
FIG. 6 is a conceptual diagram illustrating the interconnectivity of the nozzles 120 and the flame element 104.

FIG. 6 is a conceptual diagram illustrating the interconnectivity of the nozzles 120 and the flame element 104. In the illustrated embodiment, a ring tube 602 is utilized to interconnect each of the nozzles 120 with an air source (240 in FIG. 2) with conduit 230. Each nozzle 120 includes a base 620 and an extension 622. The base 620 of each nozzle 120 is hollow and connects to the ring tube 602. The extensions 622 are also hollow and as such, a path for the air-flow from air source 240 extends from the air source, through conduit 230, through the ring tube 602 and through the base 620 and extension 622 of each nozzle.

Further, the fire element 104 includes one or more tube rings that are fluidly connected to a fuel source through conduit 532.

It should be appreciated that the embodiment presented in FIG. 6 is a non-limiting example of one configuration. Other configurations may include a square tube, a split tube with air input in the middle or on one end, a single multiple T or Y connector or multiple T or Y connectors. In some embodiments, the conduit 230 and/or the ring tube 602 or equivalent may include a valve, such as a ball valve, that can be adjusted increase or decrease the air-flow and PSI of the air delivered. Similarly, a valve, such as a ball valve may be used to control the fuel supply to the fire element 104.

Figure 7A:
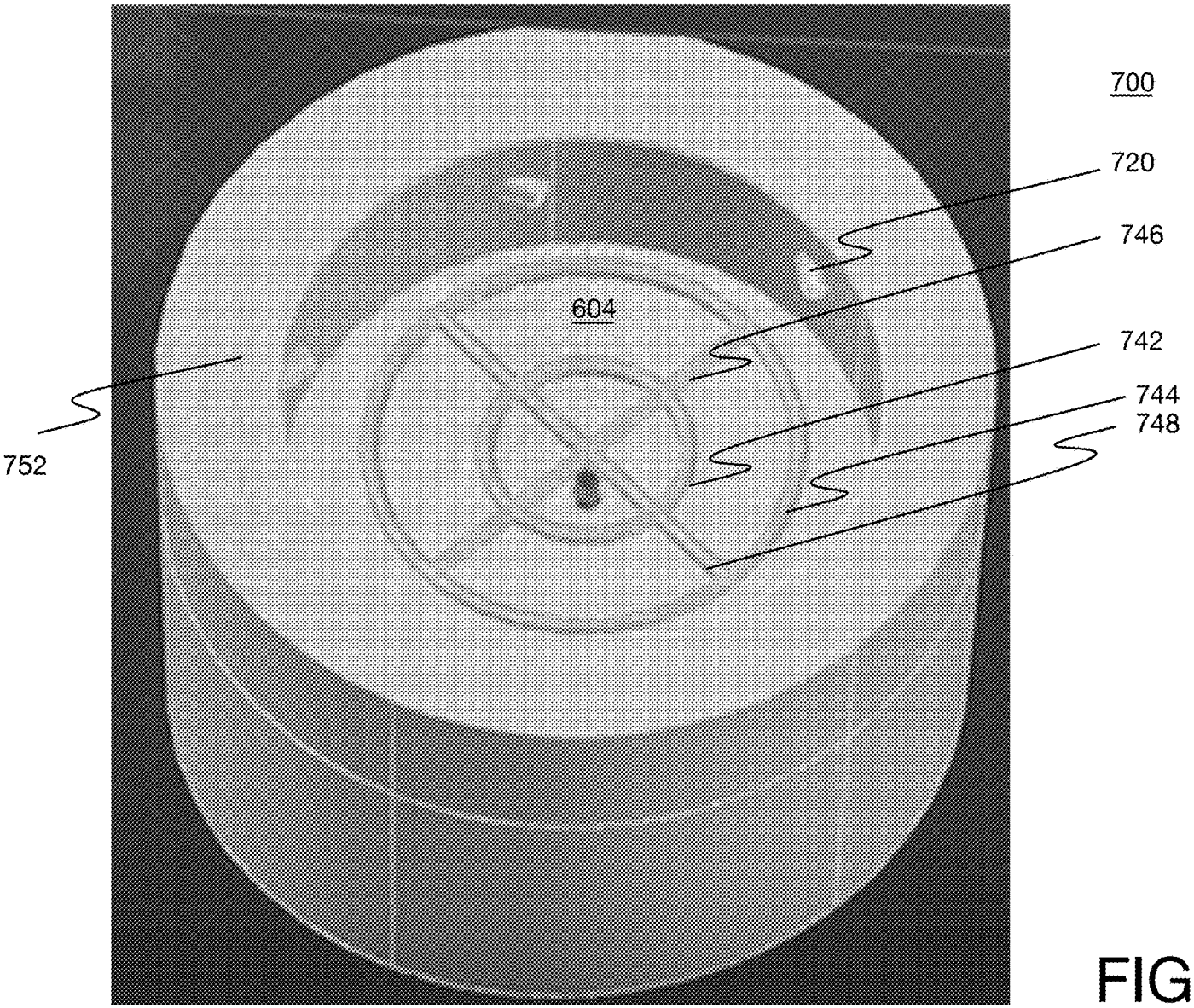
FIG. 7A. is a perspective diagram of firenado pit embodiment with a round recessed area.

FIG. 7A. is a perspective diagram of firenado pit embodiment with a round recessed area. The firenado pit 700 is illustrated as including a round fire element 704 with two concentric circular tubes, inner tube 742 and outer tube 744 joined together with two cross members 746 and 748. A plurality of nozzles 720 are spaced round the fire element 704, similar to what is presented in FIGS. 1, 3, 4, 5, and 6, with the exception that nozzles 720 are embedded within a wall 752 of the firenado pit 700, with just a tip of the nozzles 720 protruding from the wall 752.

Figure 7B:
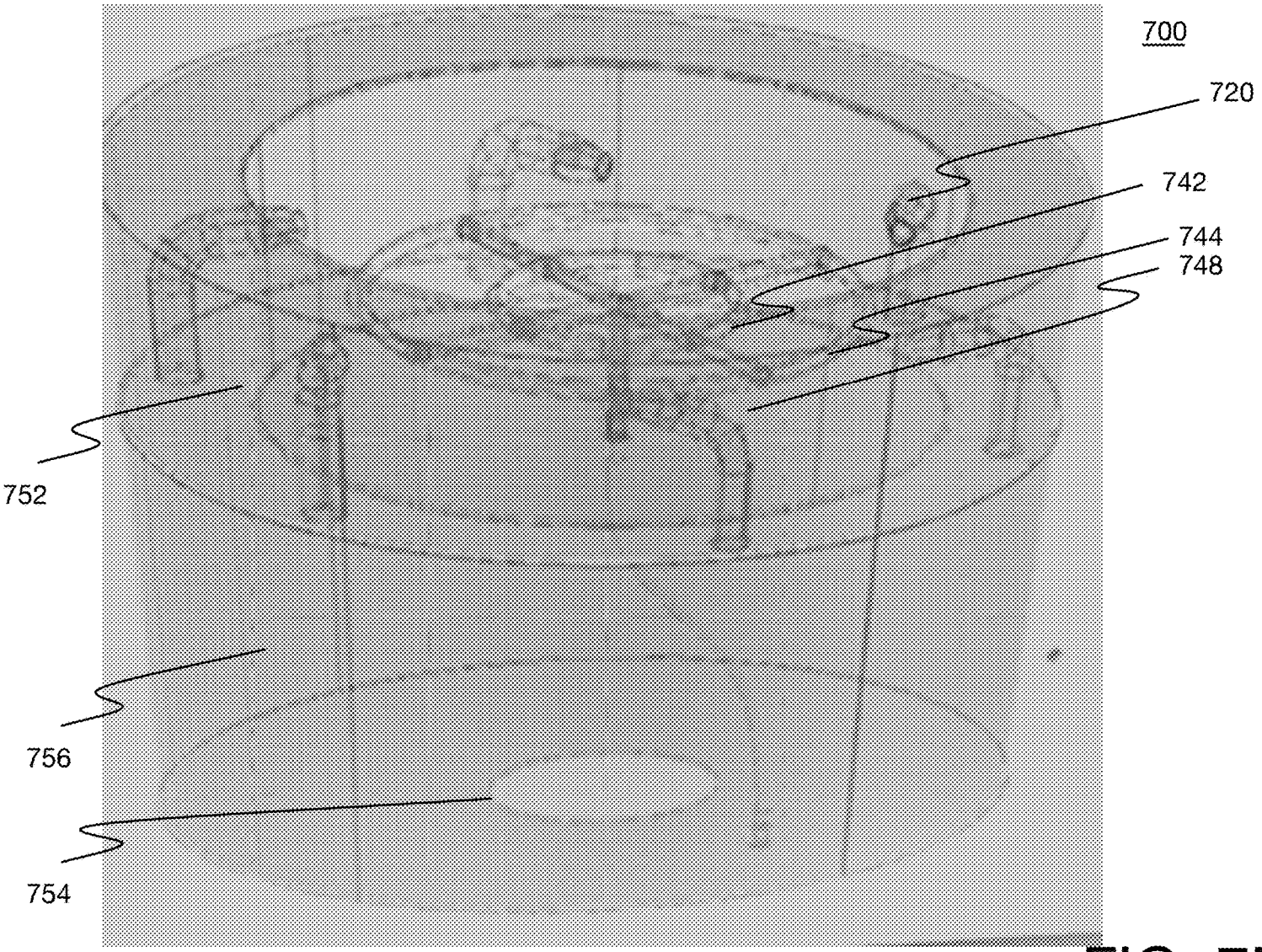
FIG. 7B is a perspective diagram of the embodiment of FIG. 7A with the walls of the firenado pit 700 transparent to reveal further details.

FIG. 7B is a perspective diagram of the embodiment of FIG. 7A with the walls of the firenado pit 700 transparent to reveal further details. The bottom of the firenado pit includes an aperture 754 through which a conduit from the air source and or fire element 704 fuels source can pass. However, in some embodiments, the air source may reside within the firenado 700 lower chamber 756. In such an embodiment, a power line may pass through the aperture 754 to power the air source. In some embodiments, a fuel tank may be located within the lower chamber 756 to feed the flame element.

Figure 7C:
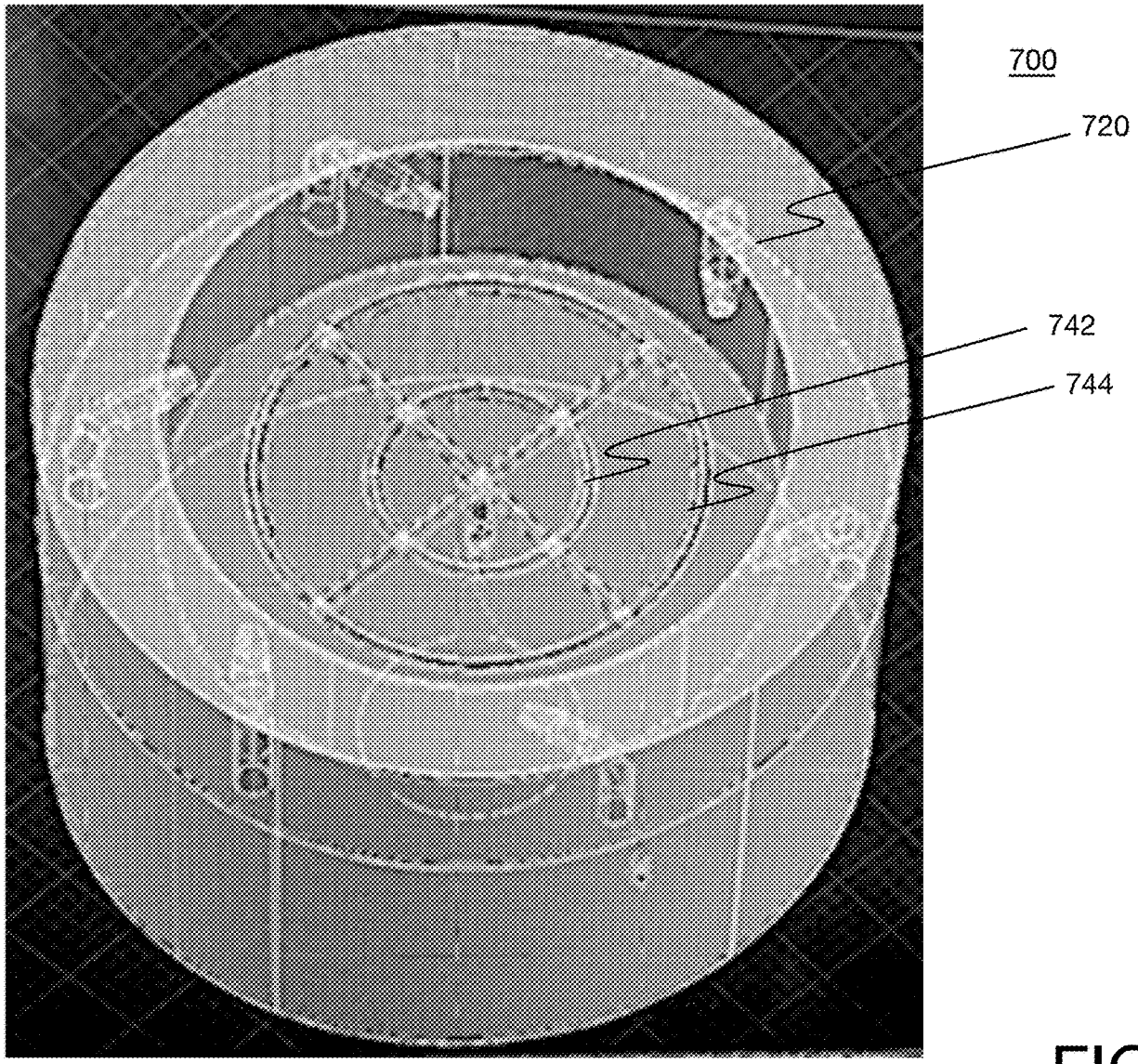
FIG. 7C is a perspective diagram of the embodiment of FIG. 7A with the walls of the firenado pit transparent and from a different angle.

FIG. 7C is a perspective diagram of the embodiment of FIG. 7A with the walls of the firenado pit transparent and from a different angle.

Figure 8A:
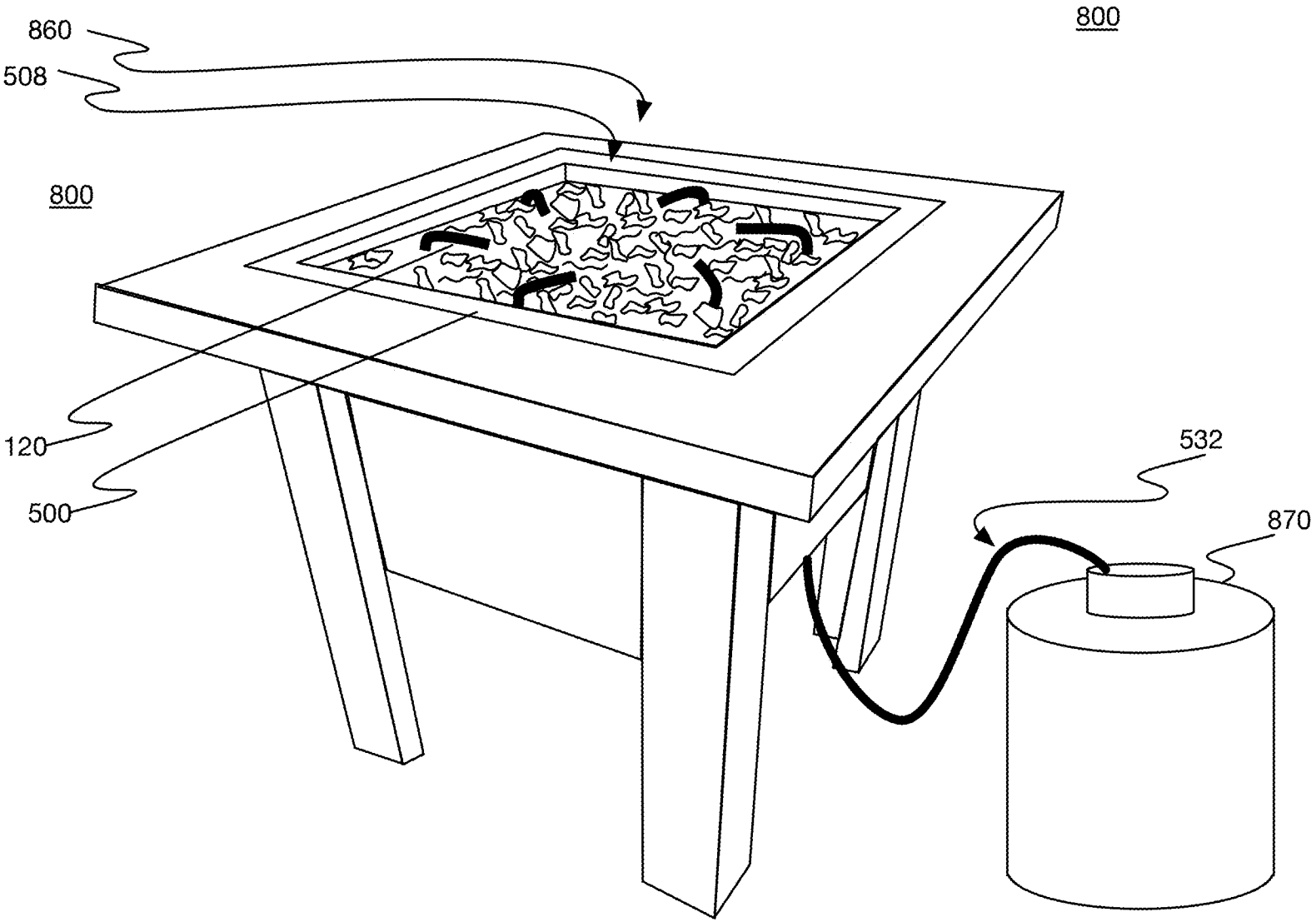
FIG. 8A is a diagram of an exemplary embodiment of the firenado of utilizing the insert of FIG. 5.

FIG. 8A is a diagram of an exemplary embodiment of the firenado of utilizing the insert of FIG. 5. The firenado fire pit 800 includes a bed of pumas or stones 860 in the recess of the insert 500 such that the fire element 104 is fully covered but the air nozzles 120 are above the surface of the pumas or stone bed to freely direct air towards an open flame and thus induce the fire tornado. A tube or conduit 532 connects the fuel source 870 to the flame element 104.

Figure 8B:
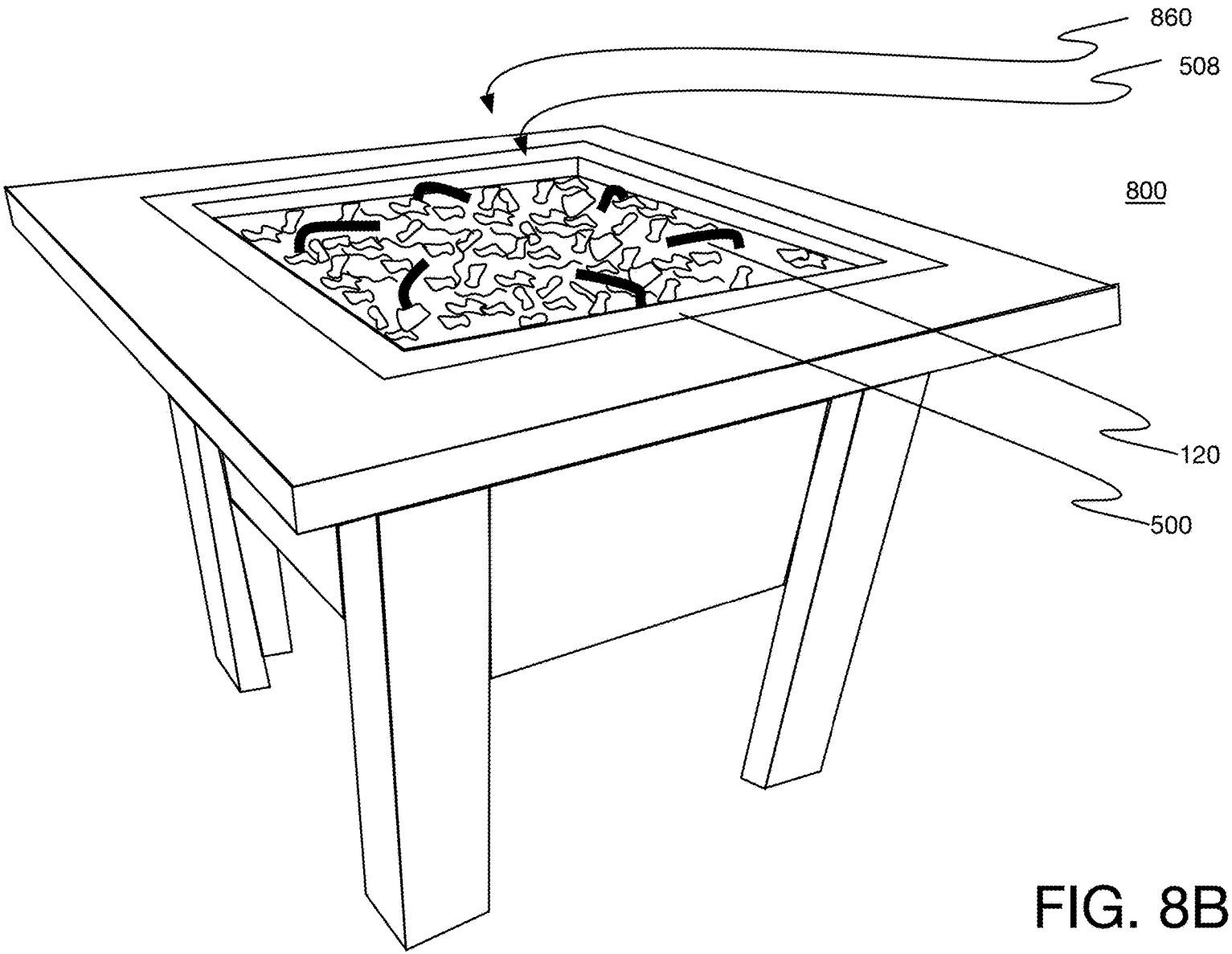
FIG. 8B is an alternative view of the embodiment of FIG. 8A.

FIG. 8B is an alternative view of the embodiment of FIG. 8A.

Figure 8C:
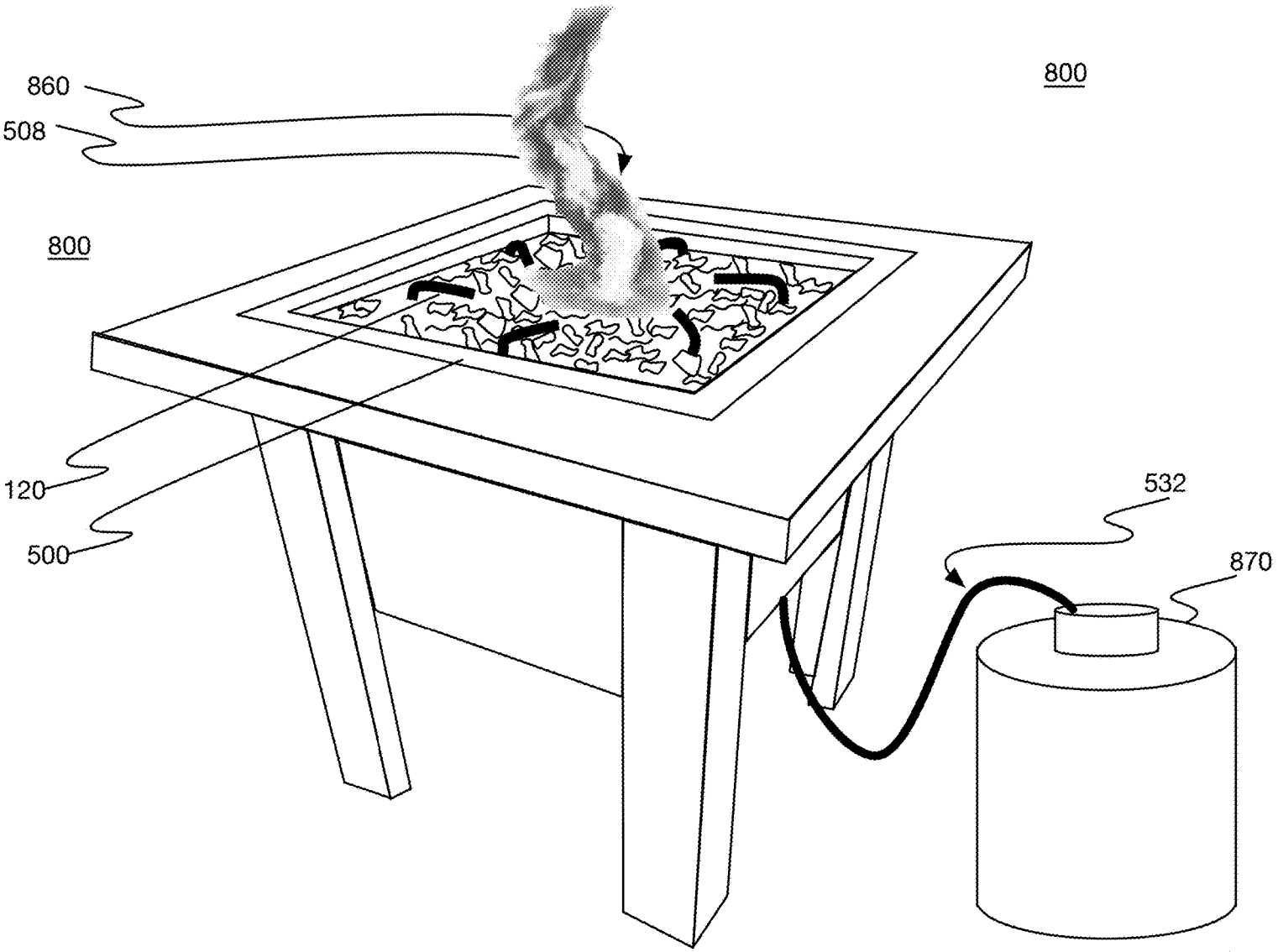
FIG. 8C illustrates the embodiment of FIG. 8A in operation.

FIG. 8C illustrates the embodiment of FIG. 8A in operation.

One specific embodiment includes a method for inducing a flame into a fire tornado. The method includes setting a flame element within a recessed void of a shell or insert. The claim element is coupled to a fuel source and thus receives a fuel, such as propane, natural gas, etc., to be burned. The flame element is then ignited. The embodiment also includes setting a plurality of air nozzles around the periphery of the flame element and insuring that each of the plurality of air nozzles is pointing towards an edge of the flame element at an angle that is not 0 degrees, or that is greater than 0 degrees relative to a line running from the nozzle to the center of the flame element. Thus, the nozzle is not pointing directly at the edge of the flame element, but rather is at an angle that is directed towards the edge, so that the air flow is pushed around the flame element. For instance, in some embodiments the angle can range from greater than 0 to 90 degrees relative to a line passing through the nozzle to the center of the flame element. At the particular angle, the method comprises delivering air to each of the plurality of air nozzles from an air source. As a result, the air flow of air from each of the plurality of air nozzles creates eddy currents within the recessed void to induce the fire tornado.

In some embodiments, the flame element is circular, and the angle of the air flow from a particular nozzle towards the flame element is along or proximate to a tangential line. For instance, the air flow may be tangential to the edge of the flame element, plus or minus 5 degrees, or in some embodiments plus or minus 10 degrees, or in other embodiments, plus or minus 20 degrees or more.

In some embodiments, the plurality of air nozzles around the periphery of the flame element includes 2 or more nozzles, or in some embodiments 4-8 nozzles, or in some embodiments 6 nozzles.

In some embodiments, each of the plurality of air nozzles can be individually adjusted to change the particular angle of that particular nozzle. However, in some embodiments, the plurality of air nozzles are interconnected such that adjusting the angle of one of the air nozzles results in adjusting each of the remaining air nozzles.

In higher-end embodiments, the firenado may include a level of intelligence. As such, the firenado may be able to monitor the height of the fire tornado, the velocity of the currents, the turbulence of the fire tornado, etc. and then make adjustments automatically to maximize the effectiveness. For instance, light sensor can be used to determine how high the flames are reaching from the flame element. Further, sensors may be used to measure the turbulence in the flame and or the air flow within the recessed void. The system may then automatically make adjustments to the nozzles, air flow, air pressure and flame size to optimize the firenado. Further, the firenado may include a user interface that allows the user to dial in a specific desire on the height and turbulence of the firenado. In such a system, adjustments can be made to maintain operation within the selected parameters.

As such, the firenado may include a processor running a software program to control a valve to regulate air flow and fuel flow, to adjust the angles of the nozzles, to adjust the size of the flame, to adjust the aperture size of the hole in the nozzle providing air flow etc.

Figure 9:
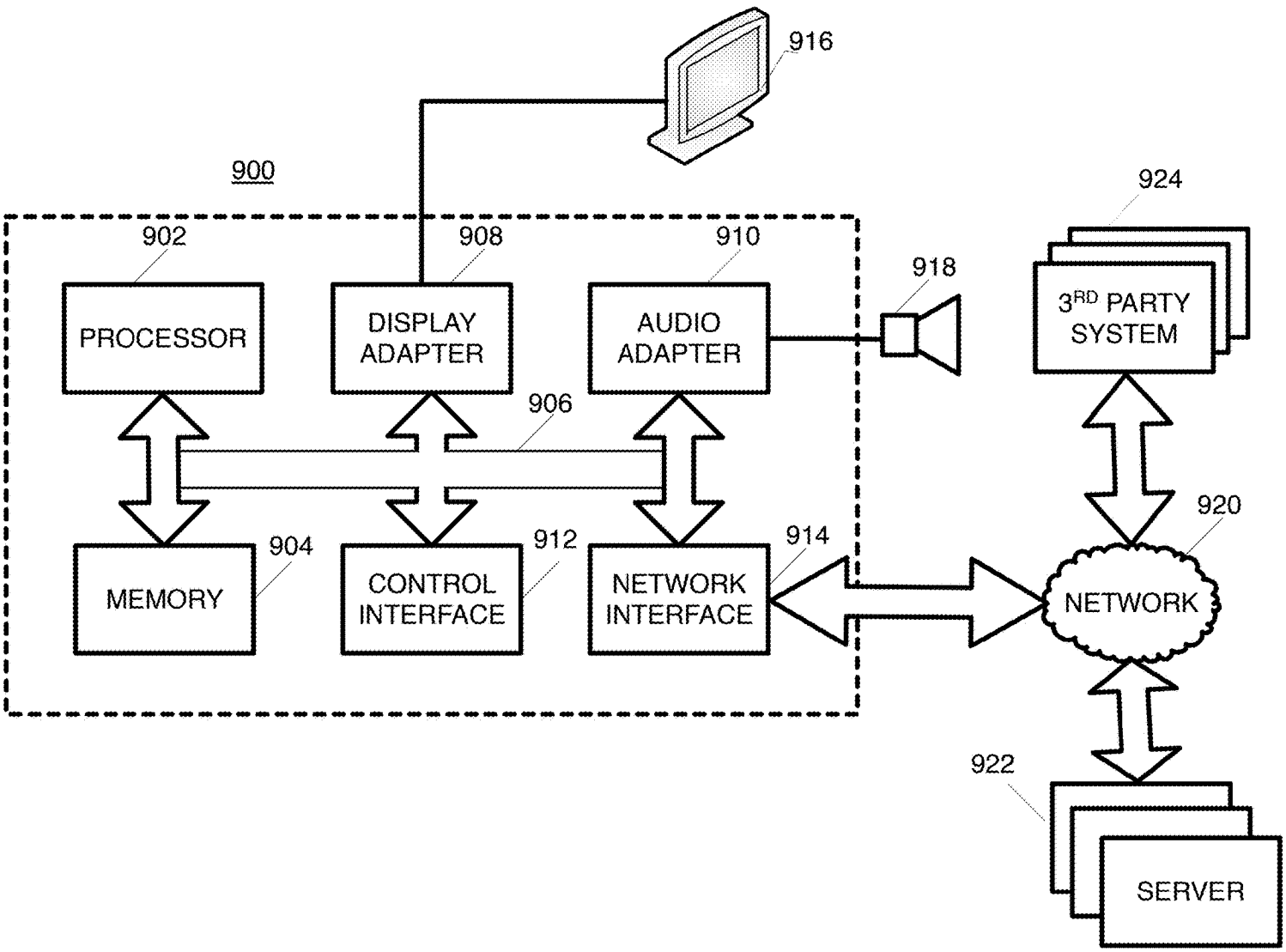
FIG. 9 is a functional block diagram of the components of an exemplary embodiment of system or sub-system operating as a controller or processor 900 that could be used in various embodiments of the disclosure for controlling aspects of the various embodiments.

FIG. 9 is a functional block diagram of the components of an exemplary embodiment of system or sub-system operating as a controller or processor 900 that could be used in various embodiments of the disclosure for controlling aspects of the various embodiments. FIG. 9 could server as the backbone or platform for any of the components, systems or devices presented herein, including but not limited to servers, mobile devices, computers, subscriber devices, networked devices, etc. It will be appreciated that not all of the components illustrated in FIG. 9 are required in all embodiments of the activity monitor but, each of the components are presented and described in conjunction with FIG. 9 to provide a complete and overall understanding of the components. The controller can include a general computing platform 900 illustrated as including a processor/memory device 902/904 that may be integrated with each other or, communicatively connected over a bus or similar interface 906. The processor 902 can be a variety of processor types including microprocessors, micro-controllers, programmable arrays, custom IC's etc. and may also include single or multiple processors with or without accelerators or the like. The memory element of 904 may include a variety of structures, including but not limited to RAM, ROM, magnetic media, optical media, bubble memory, FLASH memory, EPROM, EEPROM, etc. The processor 902, or other components in the controller may also provide components such as a real-time clock, analog to digital convertors, digital to analog convertors, etc. The processor 902 also interfaces to a variety of elements including a control interface 912, a display adapter 908, an audio adapter 910, and network/device interface 914. The control interface 912 provides an interface to external controls, such as sensors, actuators, drawing heads, nozzles, cartridges, pressure actuators, leading mechanism, drums, step motors, a keyboard, a mouse, a pin pad, an audio activated device, as well as a variety of the many other available input and output devices or, another computer or processing device or the like. The display adapter 908 can be used to drive a variety of alert elements 916, such as display devices including an LED display, LCD display, one or more LEDs or other display devices. The audio adapter 910 interfaces to and drives another alert element 918, such as a speaker or speaker system, buzzer, bell, etc. The network/interface 914 may interface to a network 920 which may be any type of network including, but not limited to the Internet, a global network, a wide area network, a local area network, a wired network, a wireless network or any other network type including hybrids. Through the network 920, or even directly, the controller 900 can interface to other devices or computing platforms such as one or more servers 922 and/or third party systems 924. A battery or power source provides power for the controller 900.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A method inducing a flame into a fire tornado, the method comprising the actions of:

setting a flame element in a center of a recessed void;

delivering a flammable gas to the flame element;

igniting the flammable gas at the flame element;

setting a plurality of adjustable nozzles to deliver non-combustible air around the periphery of the flame element, with each adjustable nozzle adjusted to point towards an edge of the flame element at an angle that is greater than 0 degrees relative to a line running from the nozzle to the center of the fire element;

delivering the air to each of the plurality of air nozzles from a pressurized air source to create wind turbulence; and adjusting the angle of the adjustable nozzles to adjust the level of wind turbulence;

whereby an air flow of air from each of the plurality of air nozzles creates eddy currents within the recessed void to induce the fire tornado.

2. The method of claim 1, wherein the action of setting the plurality of air nozzles further comprises setting the air nozzles to an angle ranging from greater than 0 to 90 degrees wherein air flow from a particular nozzle strikes the edge of the flame element.

3. The method of claim 2, wherein the flame element is circular, and the air flow from a particular nozzle strikes the edge of the flame element at substantially a tangential line.

4. The method of claim 3, wherein the action of setting a plurality of air nozzles around the periphery of the flame element comprises setting 4 to 8 nozzles around the periphery of the flame element.

5. The method of claim 3, wherein the action of setting a plurality of air nozzles around the periphery of the flame element comprises setting 6 nozzles around the periphery of the flame element.

* * * * *